US005214403A

United States Patent [19]

Bogaerts et al.

[11] Patent Number: 5,214,403

[45] Date of Patent: May 25, 1993

[54] INDUCTIVE DEVICE COMPRISING A TOROIDAL CORE

[75] Inventors: Daniel N. L. G. Bogaerts, Braine-L'Alleud; Raymond J. P. Van der Borght, Messelbroek, both of Belgium

[73] Assignee: U.S. Philips Corporation, New York, N.Y.

[21] Appl. No.: 804,571

[22] Filed: Dec. 10, 1991

[30] Foreign Application Priority Data

Dec. 14, 1990 [NL] Netherlands ..... 9002753

[51] Int. Cl.[5] ..... H01F 15/04; H01F 27/30

[52] U.S. Cl. ..... 336/84 C; 336/90; 336/200; 336/223; 336/229

[58] Field of Search ..... 336/84 R, 84 C, 90, 336/200, 223, 229, 82

[56] References Cited

U.S. PATENT DOCUMENTS

| | | | |
|---|---|---|---|
| 1,994,767 | 3/1935 | Heintz | 336/229 X |
| 2,975,386 | 3/1961 | Coy et al. | 336/229 |
| 3,564,708 | 2/1971 | Harris | 336/229 |
| 4,536,733 | 8/1985 | Shelly | 336/200 |

FOREIGN PATENT DOCUMENTS

| | | | |
|---|---|---|---|
| 083567 | 7/1983 | European Pat. Off. | 336/229 |
| 55-128805 | 10/1980 | Japan | 336/229 |
| 2197544 | 5/1988 | United Kingdom | 336/229 |

OTHER PUBLICATIONS

IBM Technical Disclosure Bulletin, vol. 32, No. 4B, Sep. 1989, New York US pp. 323–324; "High Manufacturability, Low Cost Torroidal Inductor".

*Primary Examiner*—Thomas J. Kozma

[57] ABSTRACT

An inductive device comprises a first winding which is provided on a core and which is composed of electrically conductive segments which are shaped approximately as a U-shaped plate having two substantially parallel end portions of unequal width and a wedge-shaped central portion. The segments are formed as metallized portions of the outer surface of a cap which is made of an electrically insulating material and which is shaped as a ring having a U-shaped cross-section. The segments are electrically isolated from one another by non-metallized strip-shaped portions of the outer surface of the cap. The cap comprises includes metallized pins which constitute connection members for the segments and which are connected to electrical conductors, for example, on a printed circuit board. In conjunction with the segments, the conductors constitute the first winding.

11 Claims, 3 Drawing Sheets

INDUCTIVE DEVICE COMPRISING A TOROIDAL CORE

BACKGROUND OF THE INVENTION

This invention relates to an inductive device comprising a core of a soft-magnetic material in the form of a torus having a central hole. The core is enclosed by at least a first winding comprising a number of electrically conductive segments which are shaped approximately as a U-shaped plate having two substantially parallel end portions of unequal width and a wedge-shaped central portion, the free ends of the end portions being provided with connection members, said segments enclosing the core so that the end portions of smaller width project through the central hole and the end portions of larger width are situated on the outer side of the toroidal core. Electrical conductors are connected to the connection members, said conductors constituting the first winding in conjunction with the segments. The device may be, for example a transformer or a coil.

A device of this kind is known from U.S. Pat. No. 4,536,733. In the known device the segments forming part of the first winding (constituting the secondary winding of a transformer) are constructed as U-shaped metal clips arranged over the core with the primary winding. The segments comprise integral pin-shaped connection members which project through plated-through holes in a printed circuit board and are soldered to the metallization. The configuration of the first winding is determined by the course of conductor tracks which are provided on the board so as to establish connections between the connection members in conformity with a predetermined pattern. The segments must be individually arranged on the board. The mechanical construction of the transformer is completed only after the segments have been soldered to the board. This method of mounting is comparatively time-consuming and expensive and it is necessary to deliver the transformer in the form of unassembled components (the core provided with the primary winding plus the segments). The user is then expected to supply the board and to complete the mounting.

SUMMARY OF THE INVENTION

It is an object of the invention to provide a device of the kind set forth which can be comparatively simply manufactured and which can be delivered, if desired, as a single, fully assembled component.

To achieve this, the device in accordance with the invention is characterized in that the segments are formed as metallized portions of the outer surface of a cap which is made of an electrically insulating material and which is arranged around the core which is in the form of a ring having a U-shaped cross-section, said segments being electrically isolated from one another by non-metallized strip-shaped portions of the outer surface of the cap.

When the cap is arranged around the core, all segments are thus simultaneously mounted. The core and the cap fitted thereon constitute a single component which can be readily handled. As in the known device, the customer himself can determine the configuration of the first winding by selection of the course of the conductors on a printed circuit board on which the device is to be mounted. If desired, it is alternatively possible to interconnect the connection members in a desired pattern in advance. The configuration of the first winding has thus already been defined when the device is delivered.

An embodiment of the device in accordance with the invention is characterized in that the non-metallized strip-shaped portions are situated on ridges extending on the outer side of the cap between each pair of adjacently situated segments. This embodiment offers the advantage that the entire surface of the cap, including the ridges, can be metallized, after which the ridges are ground off or milled so far that the metal layer on the ridges is interrupted. This is a comparatively simple method of forming the segments isolated by the separated strips.

A further embodiment of the device in accordance with the invention is characterized in that the connection members are formed by metallized pins which are made of the same insulating material as the cap and are integral with the cap. The pins can be formed on the cap without additional expenditure during the manufacture of the cap (for example, by injection moulding) and be metallized during the metallization of the segments.

A further preferred embodiment of the device in accordance with the invention is characterized in that between the core and the first winding there is provided at least a second winding which is enclosed by an electrically insulating housing which consists of two portions in the form of a torus having a U-shaped cross-section, which portions are arranged over the second winding so that their open sides face one another. The housing provides suitable separation isolation of the first and the second winding.

In some cases it is desirable to arrange an electrically conductive shield between the first and the second winding. To this end, a further embodiment of the device in accordance with the invention is characterized in that the inner surface of the cap is metallized and constitutes, in conjunction with a ring-shaped lid which closes the open end of the cap an electrically conductive shield between the first and the second winding.

BRIEF DESCRIPTION OF THE DRAWINGS

These and other aspects of the invention will be described in detail hereinafter with reference to the drawing accompanying, in which.

DESCRIPTION OF THE PREFERRED EMBODIMENTS

Figure 1:
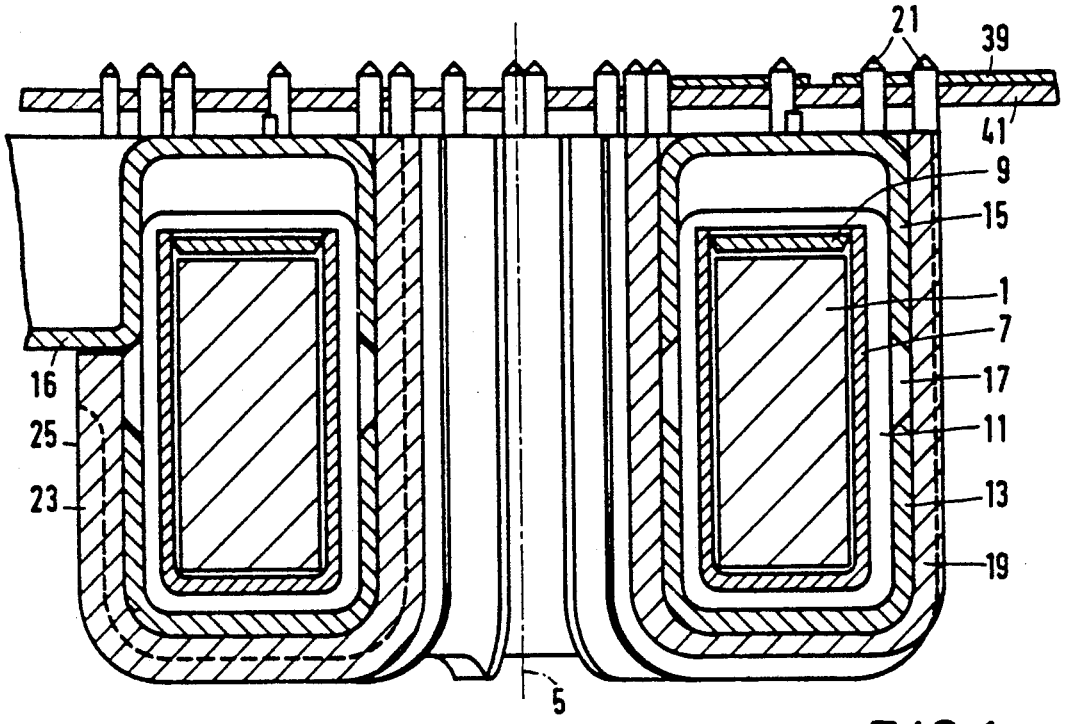
FIG. 1 is a diagrammatic longitudinal sectional view of an embodiment of the device in accordance with the invention.
Figure 2:
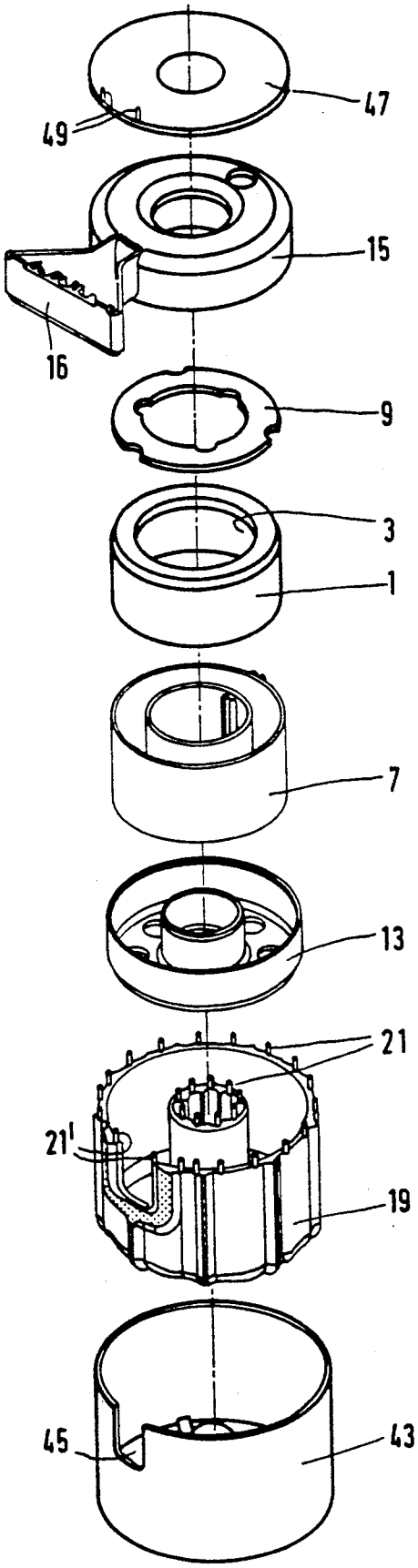
FIG. 2 is an exploded view showing a number of components of an embodiment of a device in accordance with the invention.

The device shown in FIG. 1 is a transformer comprising a core 1 of a soft-magnetic material, for example ferrite. As is clearly shown in FIG. 2, the core 1 is shaped as a torus having a central hole 3. The core 1 has a rotationally symmetrical configuration shape with a symmetry axis 5 designated by a dash-dot line. The core 1 is enclosed by a coil former which consists of a first portion 7 which is shaped as a ring having a U-shaped cross-section, and a second portion 9 which is shaped as a flat ring and which closes the opening of the first portion. The first portion 7 encloses the core 1 at three sides and the second portion 9 covers the fourth side. The coil former 7, 9 is made of an electrically insulating material, for example a suitable plastics. Around the coil former 7, 9 there is arranged a second winding 11 which is made of, for example electrically conductive wire and which constitutes the primary winding of the transformer. The second winding 11 is diagrammatically shown in FIG. 1 in the form of a single wire.

The second winding 11 is enclosed by a housing which is made of an electrically insulating material (for example, a suitable plastics) and which consists of a first portion 13 and a second portion 15. Each of the two portions 13, 15 is shaped as a ring having a U-shaped cross-section. They are arranged over the winding 11 so that their open sides face one another. It is not necessary for the two portions 13, 15 to touch one another. As appears from FIG. 1, a gap 17 can be simply maintained between said portions, the more so because the transformer is preferably encapsulated in an insulating moulding plastics as will be described hereinafter. The second portion 15 comprises a laterally projecting wire guide portion 16 for feeding out the connection wires of the second winding 11 (not shown).

The housing 13, 15, accommodating the second winding 11, is enclosed by a first winding which constitutes the secondary winding of the transformer. To this end, a cap 19 is arranged around the housing 13, 15, which cap is shaped as a ring having a U-shaped cross-section. In the outer wall of the cap 19 there is formed a cut-out for the wire guide portion 16. The cap 19 will be described also with reference to the FIGS. 3 and 4.

Figure 3:
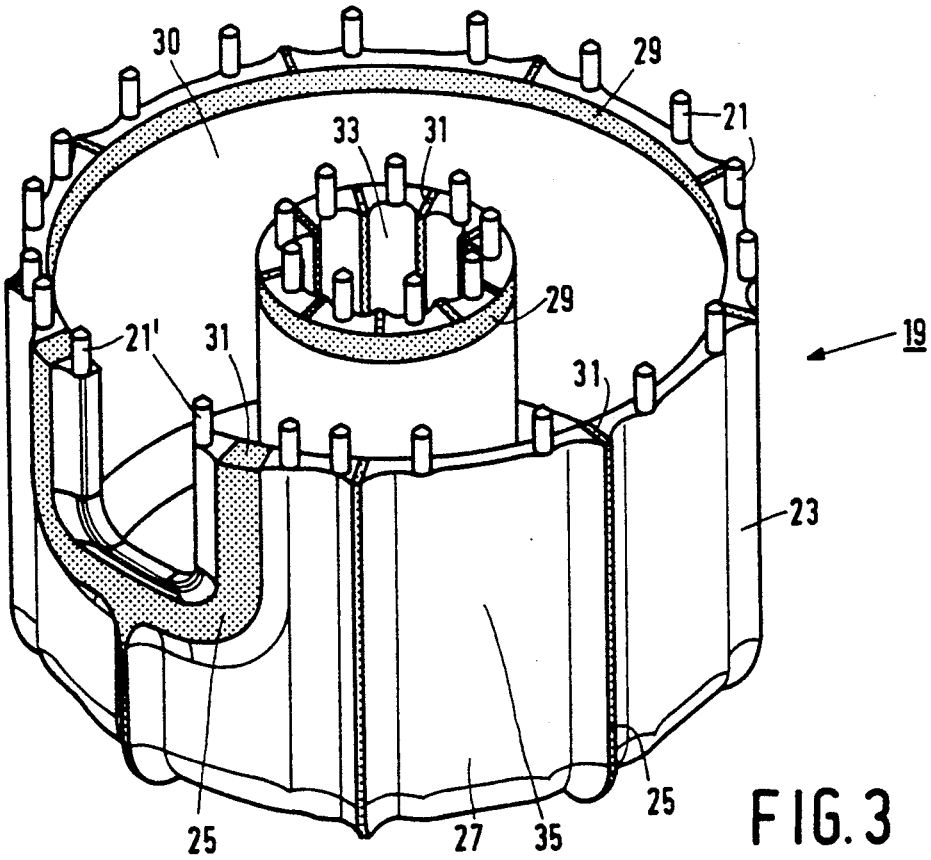
FIG. 3 is a first perspective view of an embodiment of a component of the device in accordance with the invention.
Figure 4:
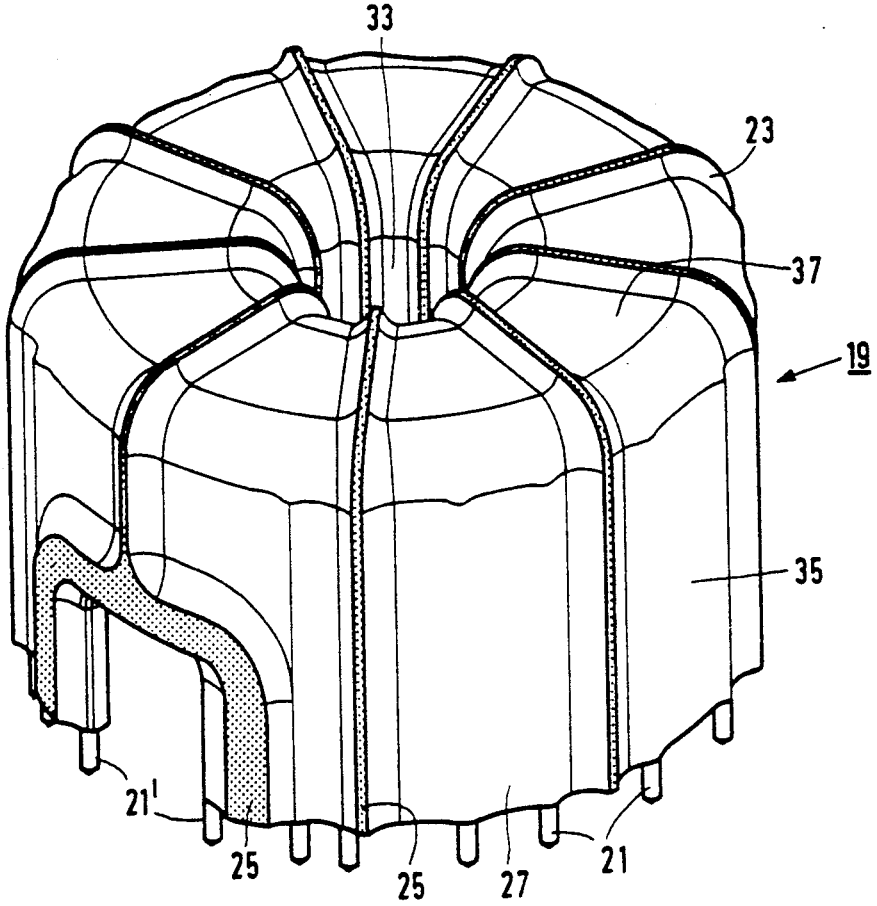
FIG. 4 is a second perspective view of the component shown in FIG. 3.

FIG. 3 is a perspective view of the cap 19 in the same position as shown in FIG. 1 (the open side facing upwards) and FIG. 4 is a perspective view of the cap in the reverse position (the open side facing downwards). The cap 19 is made of an electrically insulating plastics, for example by injection moulding. During the injection moulding process pins 21 are formed on the cap, said pins thus consisting of the same insulating material as the cap. The pins 21 are disposed in two concentric circles which bound the open side of the cap. The cap 19 comprises a number of U-shaped ridges 23 which extend across its outer surface and which project from the surface of the cap between the ridges. After injection moulding, the entire surface of the cap 19 is provided with a metal layer, for example by electroless deposition of copper. This metal layer also covers the surface of the pins 21. Subsequently, the upper portions (crests) of the ridges 23, together with the metal layer present thereon, are removed, for example by way of a milling or grinding operation, so that electrically insulating strip-shaped portions 25 are formed which extend in the form of a U across the outer surface of the cap and which isolate electrically conductive segments 27 from one another. The metal has also been removed from two circular bands 29 which are situated on the inner surface of the cap 19, near the open side of the cap, and which are connected with the strip-shaped portions 25 via short metal-free strips 31. As a result, the electrically conductive segments 27 are electrically fully isolated from one another. The inner surface of the cap 19, however, is substantially completely covered by an electrically conductive metal layer 30. As appears from FIG. 4, the electrically conductive segments 27 are shaped approximately as a U-shaped plate. This plate comprises a first, comparatively narrow end portion 33 and a second, comparatively wide end portion 35, said end portions being interconnected by a wedge-shaped central portion 37. After the cap 19 has been fitted on the core 1, the narrow first end portion 33 projects through the central hole 3 and the wide, second end portion 35 is situated at the outer side of the ring formed by the core. The wedge-shaped central portion 37 extends over one of the end faces of the core 1 (the lower end face in FIG. 1). The metallized pins 21 are electrically connected to the metal layer constituting the segments 27. They serve as connection members for electrical connection of the segments 27 to, for example conductor tracks 39 on a printed circuit board 41 (see FIG. 1).

In conjunction with the conductor tracks 39, the segments 27 form the first (secondary) winding of the transformer. As described in the cited U.S. Pat. No. 4,536,733, the configuration of the first winding can be determined by a suitable choice of the course of the conductor tracks 39.

Instead of the described embodiment, in which the cap 19 is formed so as to include ridges 23 wherefrom the crests are removed at a later stage in order to form the insulating strip-shaped portions 25, other embodiments of the cap are also feasible. For example, the cap 19 can be made using two types of plastics in a process which is known as "double shot moulding". The portions intended to form the conductive segments 27 and the pins 21 are then made of a plastics which can be readily metallized (for example, using said electroless process), the portions intended to form the strip-shaped portions 25 being made using a non-metallizable plastics. This method offers the advantage that no mechanical operations will be required after deposition of the metal layer.

Inter alia because the segments 27 enclose the core 1 and the first winding 11 almost completely, the construction of the transformer is such that a very good coupling exists between the first and the second winding and the electromagnetic field of the transformer substantially does not extend beyond the toroidal core 1.

Suitable electrical insulation of the transformer can be achieved by encapsulating it in a suitable moulding plastics. To this end, a cup-shaped housing 43 can be arranged around the cap 19 (see FIG. 2), after which the housing and the open spaces within the cap 19 are filled with a liquid plastics (not shown). After the curing of the plastics, the transformer constitutes a rugged, electrically suitably insulated component. For dissipation of any heat formed during operation of the transformer, the bottom 45 of the housing 43 preferably includes a sheet of a thermally suitably conductive material, for example aluminium. The transformer can be delivered together with the housing 43, 47 or without the housing, as desired. In the latter case the cap 19 constitutes the outer side of the transformer. In both cases the transformer forms a single mechanical component which need only be soldered onto a printed circuit board for electrical operation.

For the encapsulation of the transformer the open end of the cap 19 is preferably covered by an annular lid 47 which is electrically conductive, like the metal layer 30 on the inner surface of the cap, and which consists of, for example a layer of copper between two layers of plastics. It comprises two electrically conductive pins 49 which are connected to the copper layer and which can be connected, together with two pins 21' of the cap 19 connected to the metal layer 30, to a point of constant potential, for example a ground conductor of the board 41. The lid 47 and the metal layer 30 together constitute an electrically conductive shield which is closed substantially all around and which is arranged between the first and the second winding.

The second winding 11 in the described embodiment consists of a wire wound around the core 1. The second winding 11, however, can also be formed in a manner similar to the first winding, for example by means of metallized segments on a cap or by means of a double shot moulding technique where the core is provided with a tape of a metallizable plastics which extends helically around the core 1 and a tape of a non-metallizable plastics which extends between the turns of the first tape. When the device constitutes a coil instead of a transformer, the first winding 11 can be dispensed with.

Instead of the integral metallized plastics pins 21 and 21', use can also be made of pins which are made of a metal wire and which are embedded in the plastics of the cap 19.

We claim:

1. An inductive device comprising; a toroidal core of a soft-magnetic material having a central hole, which core is enclosed by at least a first winding comprising a number of electrically conductive segments which are shaped approximately as a U-shaped plate having two substantially parallel end portions of unequal width and a wedge-shaped central portion, free ends of the end portions being provided with connection members, said segments enclosing the core so that the end portions of smaller width project through the central hole and the end portions of larger width are situated on the outer side of the toroidal core, electrical conductors being connected to the connection members, said conductors constituting the first winding in conjunction with the segments, characterized in that the segments are formed as metallized portions of the outer surface of a cap which is made of an electrically insulating material and which is arranged around the core in the form of a ring having a U-shaped cross-section, said segments being electrically isolated from one another by non-metallized strip-shaped portions of the outer surface of the cap.

2. A device as claimed in claim 1, wherein the non-metallized strip-shaped portions are situated on ridges extending on the outer side of the cap between each pair of adjacently situated segments.

3. A device as claimed in claim 2, wherein the connection members are formed by metallized pins which are made of the same insulating material as the cap, and are integral with the cap.

4. A device as claimed in claim 3, further comprising a second winding between the core and the first winding, said second winding being enclosed by an electrically insulating housing which comprises two portions in the form of a torus having a U-shaped cross-section, which portions are arranged over the second winding so that their open sides face one another.

5. A device as claimed in claim 4, wherein the inner surface of the cap is metallized and constitutes, in conjunction with a ring-shaped lid which closes the open end of the cap, an electrically conductive shield between the first and the second winding.

6. A device as claimed in claim 1, wherein the connection members are formed by metallized pins which are made of the same insulating material as the cap and are integral with the cap.

7. A device as claimed in claim 6, further comprising a second winding between the core and the first winding, said second winding being enclosed by an electrically insulating housing which comprises two portions in the form of a torus having a U-shaped cross-section, which portions are arranged over the second winding so that their open sides face one another.

8. A device as claimed in claim 7, wherein the inner surface of the cap is metallized and constitutes, in conjunction with a ring-shaped lid which closes the open end of the cap, an electrically conductive shield between the first and the second winding.

9. A device as claimed in claim 1, further comprising a second winding between the core and the first winding, said second winding being enclosed by an electrically insulating housing which comprises two portions in the form of a torus having a U-shaped cross-section, which portions are arranged over the second winding so that their open sides face one another.

10. A device as claimed in claim 9, wherein the inner surface of the cap is metallized and constitutes, in conjunction with a ring-shaped lid which closes the open end of the cap, an electrically conductive shield between the first and the second winding.

11. A device as claimed in claim 2, further comprising a second winding between the core and the first winding, said second winding being enclosed by an electrically insulating housing which comprises two portions in the form of a torus having a U-shaped cross-section, which portions are arranged over the second winding so that their open sides face one another.

* * * * *